US010553930B2

(12) United States Patent
Billard et al.

(10) Patent No.: US 10,553,930 B2
(45) Date of Patent: Feb. 4, 2020

(54) ANTENNA SYSTEM FOR WIRELESS COMMUNICATION DEVICES AND OTHER WIRELESS APPLICATIONS

(71) Applicant: Symantec Corporation, Mountain View, CA (US)

(72) Inventors: Michael Billard, Sunnyvale, CA (US); Christopher Gaul, San Jose, CA (US); Paul Roybal, San Jose, CA (US)

(73) Assignee: SYMANTEC CORPORATION, Mountain View, CA (US)

( * ) Notice: Subject to any disclaimer, the term of this patent is extended or adjusted under 35 U.S.C. 154(b) by 40 days.

(21) Appl. No.: 15/396,271

(22) Filed: Dec. 30, 2016

(65) Prior Publication Data

US 2018/0191056 A1 Jul. 5, 2018

(51) Int. Cl.

| | |
|---|---|
| ***H01Q 1/22*** | (2006.01) |
| ***H01Q 15/16*** | (2006.01) |
| ***H01Q 1/38*** | (2006.01) |
| ***H01Q 1/52*** | (2006.01) |

(52) U.S. Cl.

CPC ..... *H01Q 1/2291* (2013.01); *H01Q 1/38* (2013.01); *H01Q 1/521* (2013.01)

(58) Field of Classification Search

CPC .... H01Q 15/161; H01Q 15/168; H01Q 1/288; H01Q 1/2291; H01Q 1/38; H01Q 1/24; H01Q 1/521; H01Q 15/16; H01Q 1/28; H01Q 1/02; H01Q 1/12; H01Q 1/1207; H01Q 1/22; H01Q 1/42; H01Q 1/52; H01Q 1/523; H01Q 9/18; H01Q 21/205; H01Q 21/30

See application file for complete search history.

(56) References Cited

U.S. PATENT DOCUMENTS

| | | | | |
|---|---|---|---|---|
| 3,681,770 | A * | 8/1972 | Alford | H01Q 21/205 343/799 |
| 5,828,339 | A * | 10/1998 | Patel | H01Q 1/246 343/700 MS |
| 6,067,053 | A * | 5/2000 | Runyon | H01Q 1/246 343/700 MS |
| 6,694,698 | B2 * | 2/2004 | Ryan | E04C 3/30 52/741.1 |
| 7,034,749 | B2 * | 4/2006 | Leeper | H01Q 3/02 343/700 MS |
| 7,570,215 | B2 * | 8/2009 | Abramov | H01Q 3/242 343/700 MS |
| 7,848,108 | B1 * | 12/2010 | Archambeault | H01L 23/3677 165/185 |

(Continued)

FOREIGN PATENT DOCUMENTS

WO 2009105587 A2 8/2009

OTHER PUBLICATIONS

International Search Report and Written Opinion issued in PCT Application No. PCT/US2017/066511 dated Jun. 3, 2018; 8 pages.

*Primary Examiner* — Tho G Phan
(74) *Attorney, Agent, or Firm* — Maschoff Brennan

(57) ABSTRACT

An antenna system for wireless communications and other wireless applications is disclosed. In one particular embodiment, the antenna system may comprise a frame with at least three facets and an antenna element mounted on each of the at least three facets, wherein each of the antenna elements are electromagnetically isolated from each other.

12 Claims, 14 Drawing Sheets

(56) References Cited

U.S. PATENT DOCUMENTS

| | | | | |
|---|---|---|---|---|
| 8,144,666 | B2 * | 3/2012 | Wilson | H01Q 1/246 370/334 |
| 9,430,006 | B1 | 8/2016 | Hayashida | |
| 9,484,636 | B2 * | 11/2016 | Mobrem | H01Q 15/168 |
| 2004/0174303 | A1 | 9/2004 | Duxbury et al. | |
| 2006/0063508 | A1 * | 3/2006 | He | H03F 3/24 455/341 |
| 2011/0291908 | A1 | 12/2011 | Hook | |
| 2013/0069839 | A1 | 3/2013 | Ash, Jr. et al. | |
| 2013/0148341 | A1 * | 6/2013 | Williams | F21S 9/022 362/184 |
| 2013/0162496 | A1 | 6/2013 | Wakabayashi | |
| 2015/0049720 | A1 | 2/2015 | Negus et al. | |
| 2015/0365276 | A1 * | 12/2015 | Porter | H01Q 21/20 370/254 |
| 2016/0316477 | A1 | 10/2016 | Negus | |
| 2017/0235035 | A1 * | 8/2017 | Proctor | G09F 9/305 362/23.05 |

* cited by examiner

ANTENNA SYSTEM FOR WIRELESS COMMUNICATION DEVICES AND OTHER WIRELESS APPLICATIONS

FIELD OF THE DISCLOSURE

The present disclosure relates generally to wireless applications and, more particularly, to an antenna system for wireless communication devices and other wireless applications.

BACKGROUND OF THE DISCLOSURE

In conventional Wi-Fi routers and other wireless devices where performance characteristics such as high throughput and long range performance are desired, conventional designs typically use large and bulky structures with limited design flexibility. Such conventional Wi-Fi routers and other wireless communication devices use such large and bulky structures to accommodate large dipole antennas and to allow the devices to be arranged to provide desired electromagnetic characteristics for transmission beam-forming patterns and receiver sensitivity.

In view of the foregoing, it may be understood that there may be significant problems and/or shortcomings associated with conventional Wi-Fi routers and other wireless communication devices.

SUMMARY OF THE DISCLOSURE

An antenna system for wireless communication devices and other wireless applications is disclosed. In some embodiments, the antenna system comprises an antenna tower fitted with several active or passive antenna elements. In some embodiments, an antenna system comprises a frame with at least three facets and an antenna element mounted on each of the at least three facets, wherein each of the antenna elements are electromagnetically isolated from each other.

In some embodiments, the antenna elements are electromagnetically isolated from each other with greater than 10 dB of orthogonality. In some embodiments, the antenna elements are electromagnetically isolated from each other with greater than 20 dB of orthogonality. In some embodiments, the antenna elements are electromagnetically isolated from each other with between 25 and 30 dB of orthogonality. In some embodiments, the antenna elements are mounted to the frame in a fixed manner.

In some embodiments, the antenna system further comprises an enclosure, wherein the antenna elements are located entirely within the enclosure. In some embodiments, the frame defines an opening between a top of the frame and a bottom of the frame. In some embodiments, the frame allows for circulation of air through the frame. In some embodiments, the frame comprises four facets. In some embodiments, the frame comprises eight facets.

In some embodiments, first and second antenna elements are mounted on first and second opposing facets and oriented vertically, and third and fourth antenna elements are mounted on third and fourth opposing facets and mounted diagonally in opposite directions from each other. In some embodiments, the first and second opposing facets are angled inward between 5 and 25 degrees, and the third and fourth opposing facets are angled inward between 0 and 5 degrees.

In some embodiments, the antenna elements are placed less than one wavelength away from each other. In some embodiments, the antenna elements are omnidirectional antennas. In some embodiments, the antenna elements are placed less than one half wavelength away from each other. In some embodiments, the antenna elements are placed less than one quarter wavelength away from each other.

In some embodiments, the antenna system further comprises a heat sink and a circuit board, wherein the heatsink is located between frame and the circuit board.

The present disclosure will now be described in more detail with reference to particular embodiments thereof as shown in the accompanying drawings. While the present disclosure is described below with reference to particular embodiments, it should be understood that the present disclosure is not limited thereto. Those of ordinary skill in the art having access to the teachings herein will recognize additional implementations, modifications, and embodiments, as well as other fields of use, which are within the scope of the present disclosure as described herein, and with respect to which the present disclosure may be of significant utility.

BRIEF DESCRIPTION OF THE DRAWINGS

In order to facilitate a fuller understanding of the present disclosure, reference is now made to the accompanying drawings, in which like elements are referenced with like numerals. These drawings should not be construed as limiting the present disclosure, but are intended to be illustrative only.

DETAILED DESCRIPTION OF EMBODIMENTS

In some embodiments, an antenna system may be realized as an antenna tower that allows for a dense antenna array to be housed within a compact package. In some embodiments, this compact design allows greater design flexibility to create compact wireless devices such as Wi-Fi routers, while still meeting desired characteristics such as electromagnetic characteristics of a beam-forming antenna array, smart antenna array, and/or directional antenna array, which can provide improved performance such as improved Wi-Fi range and throughput. A compact wireless device in accordance with some embodiments has several advantages. For example, the compact design may allow for a wider range of possible package designs, which may be desirable to consumers for functional reasons (e.g., using less space to provide desired wireless performance) and/or aesthetic reasons (e.g., allowing the creation of more iconic, appealing, and inspiring designs).

In some embodiments, the antenna tower may comprise multiple antenna elements mounted on a frame. The frame may resemble a pyramid and may, for example have multiple facets, e.g., 4 facets, 8 facets, other numbers of facets. Each of the facets may receive one or more antenna elements. Each element may be active or passive. The facets may have an angle by which they are inclined and/or declined and each antenna element may have an angle by which it is rotated (e.g., horizontal, vertical, diagonal, or another angle of rotation). Adjustments to each angle (e.g., incline and rotation) may be used to optimize isolation between antenna elements and/or to achieve a desired level of polarization diversity. The antenna tower may also be fitted with passive metallic elements that act as reflectors to shape a radiation pattern and/or isolators to augment a level of isolation between elements.

Figure 1A:
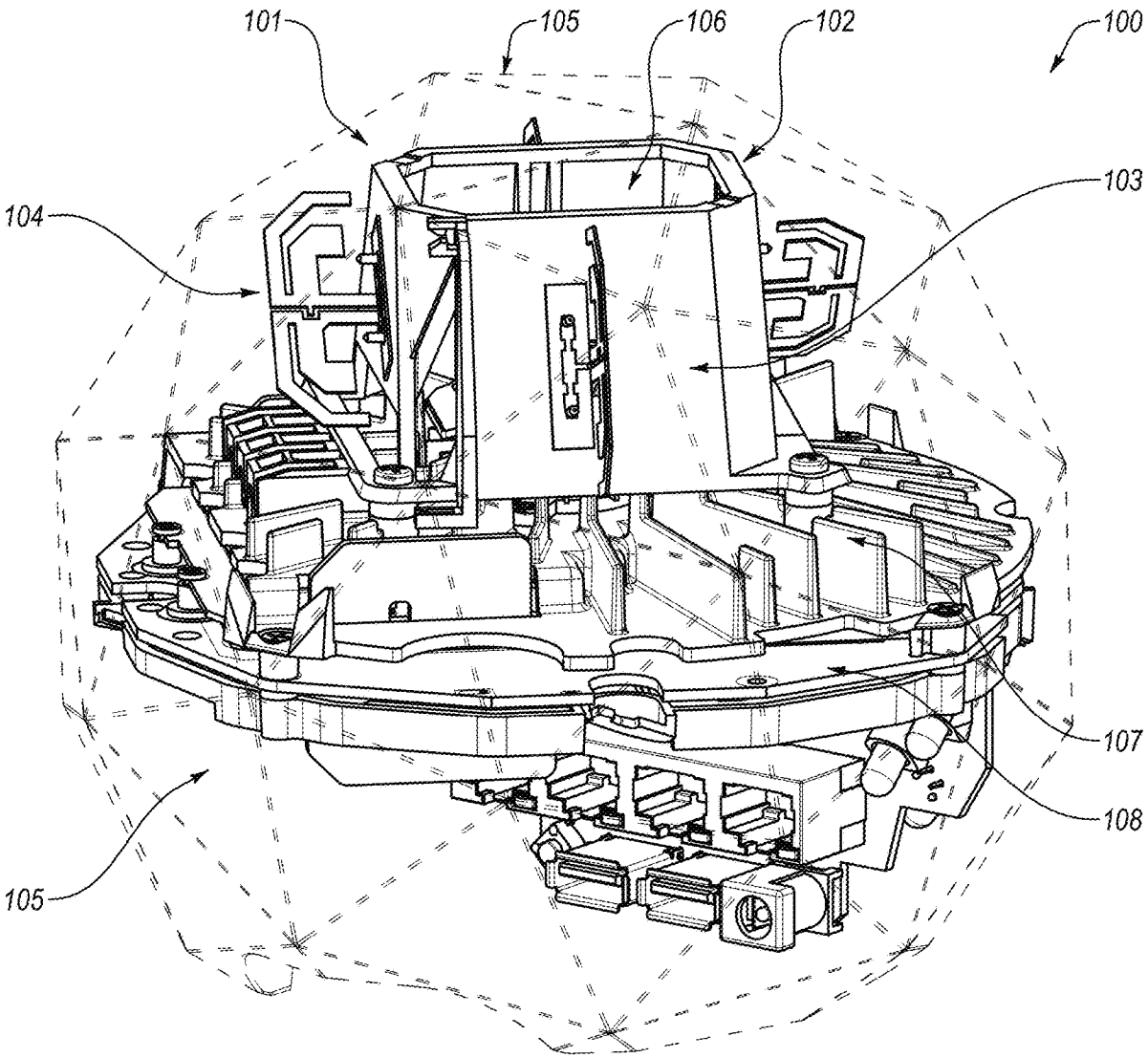
FIGS. 1A to 1H show a wireless device with an antenna system according to an exemplary embodiment.
Figure 1B:
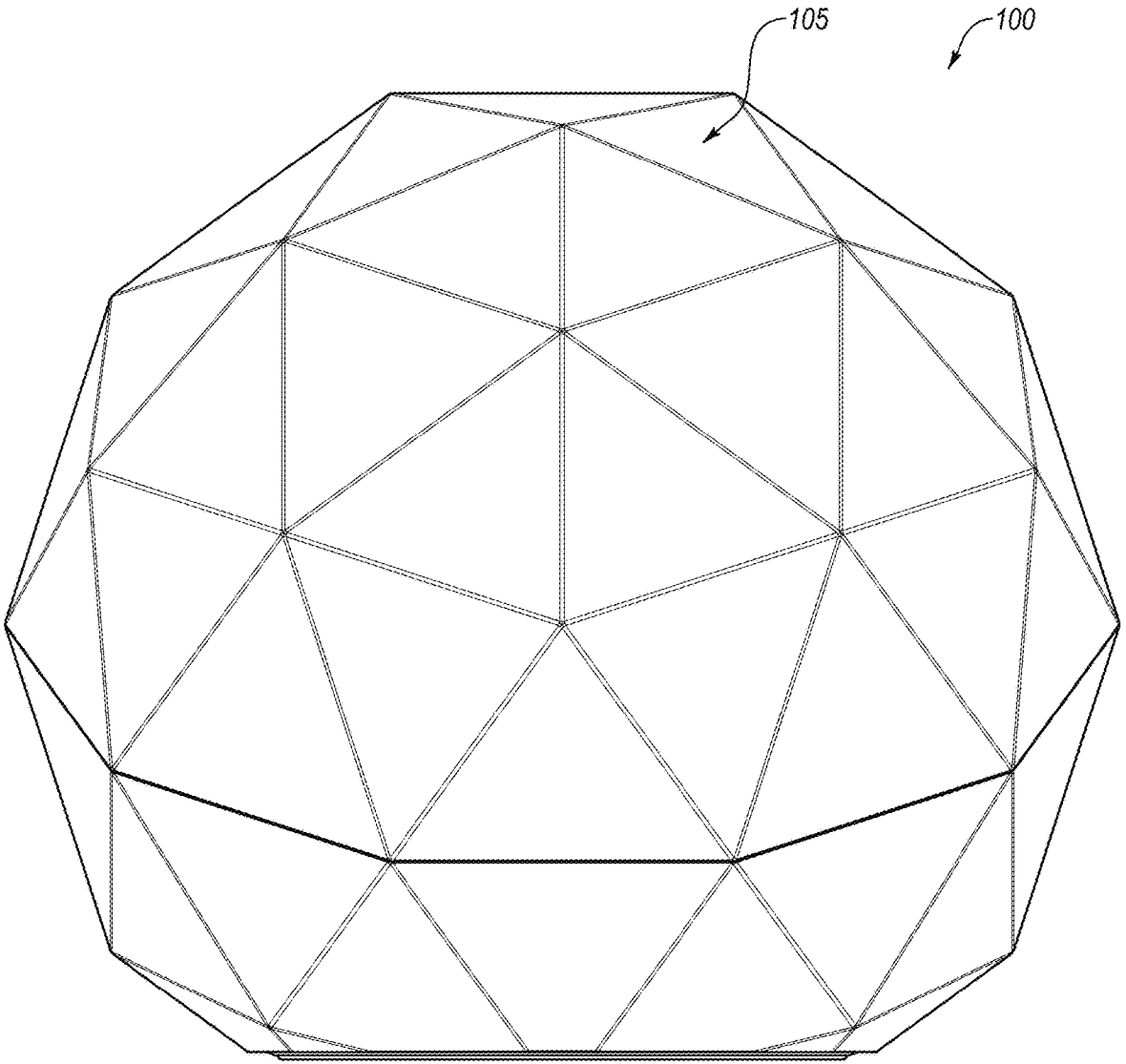
Figure 1C:
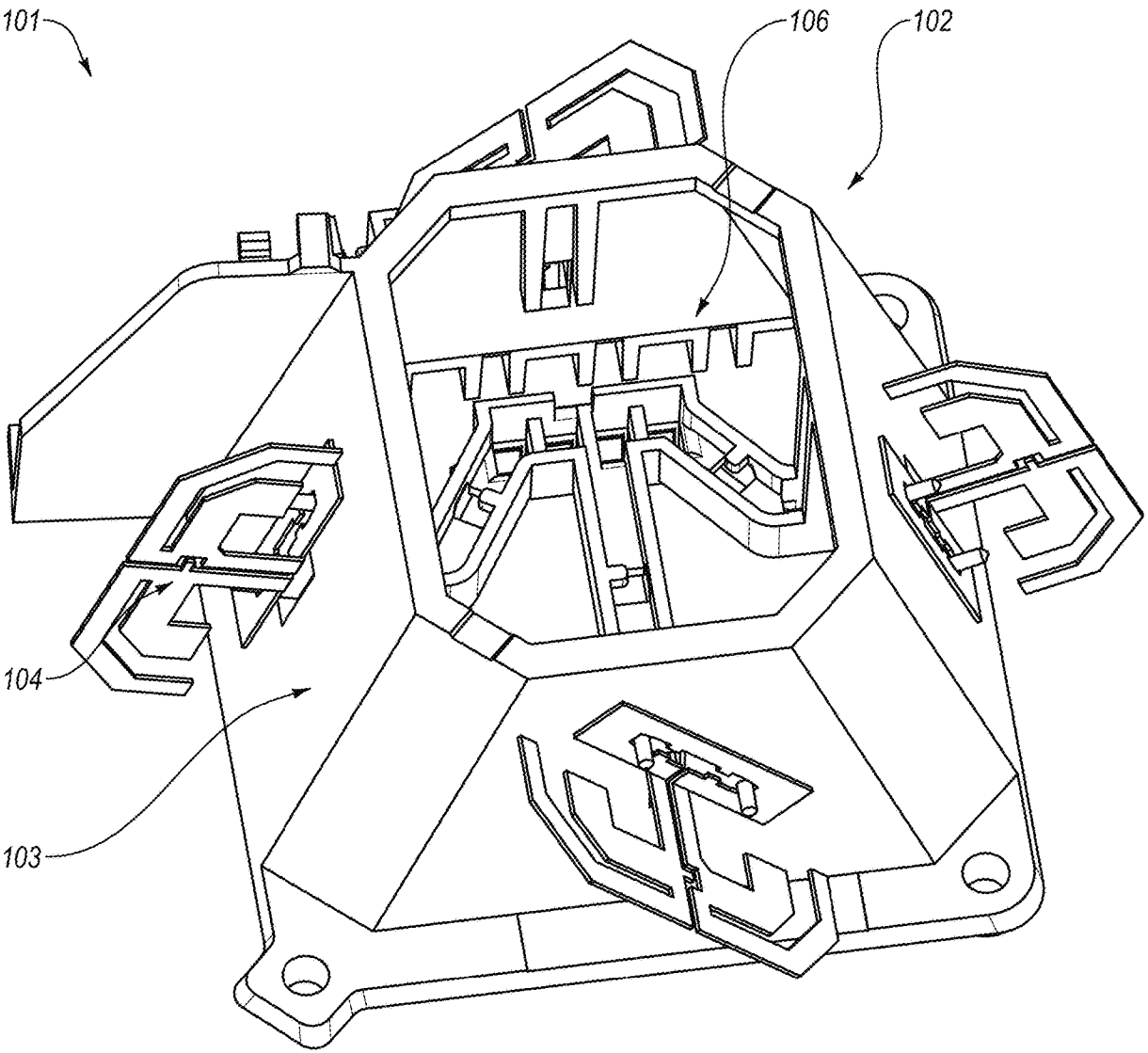
Figure 1D:
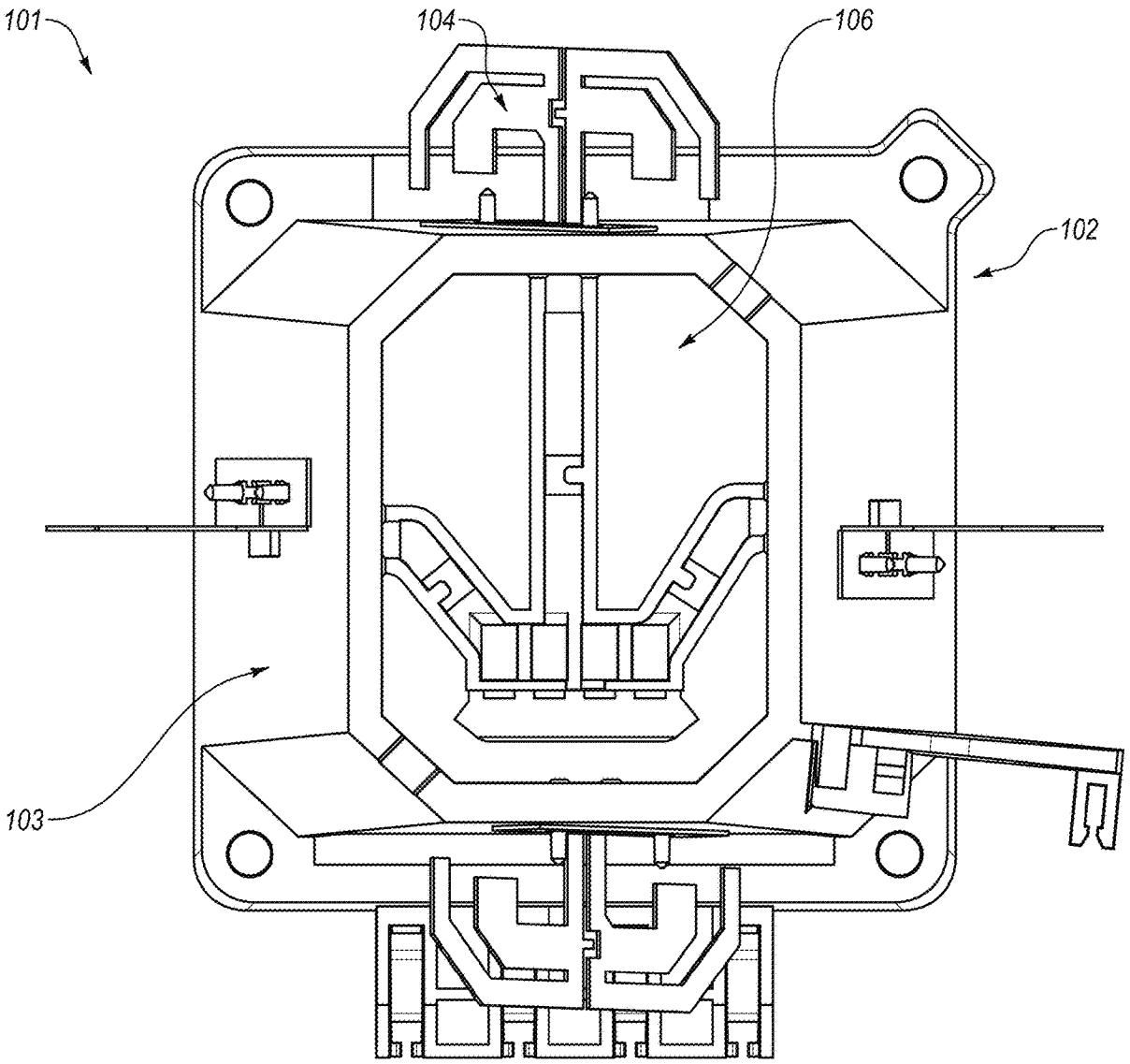
Figure 1E:
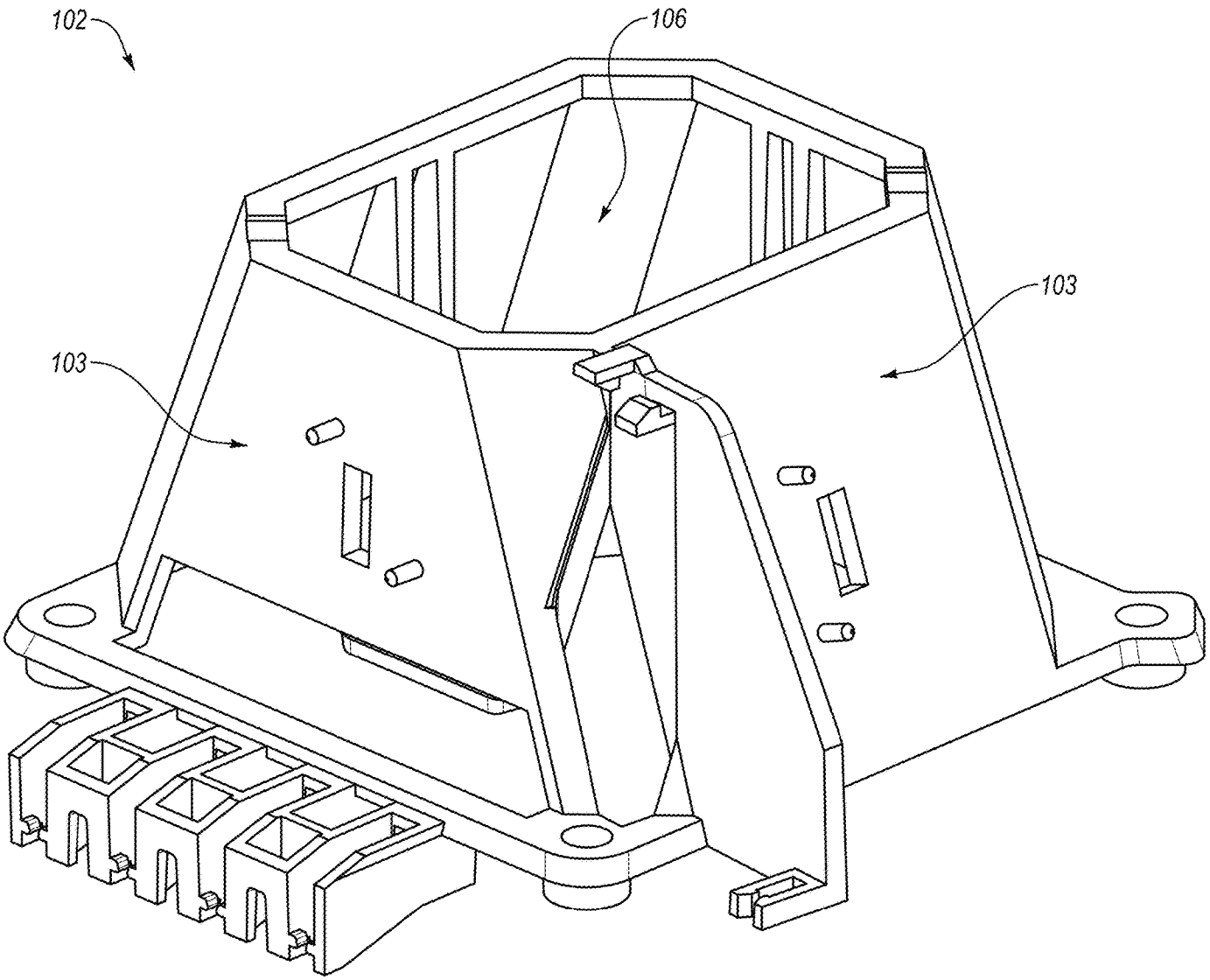
Figure 1F:
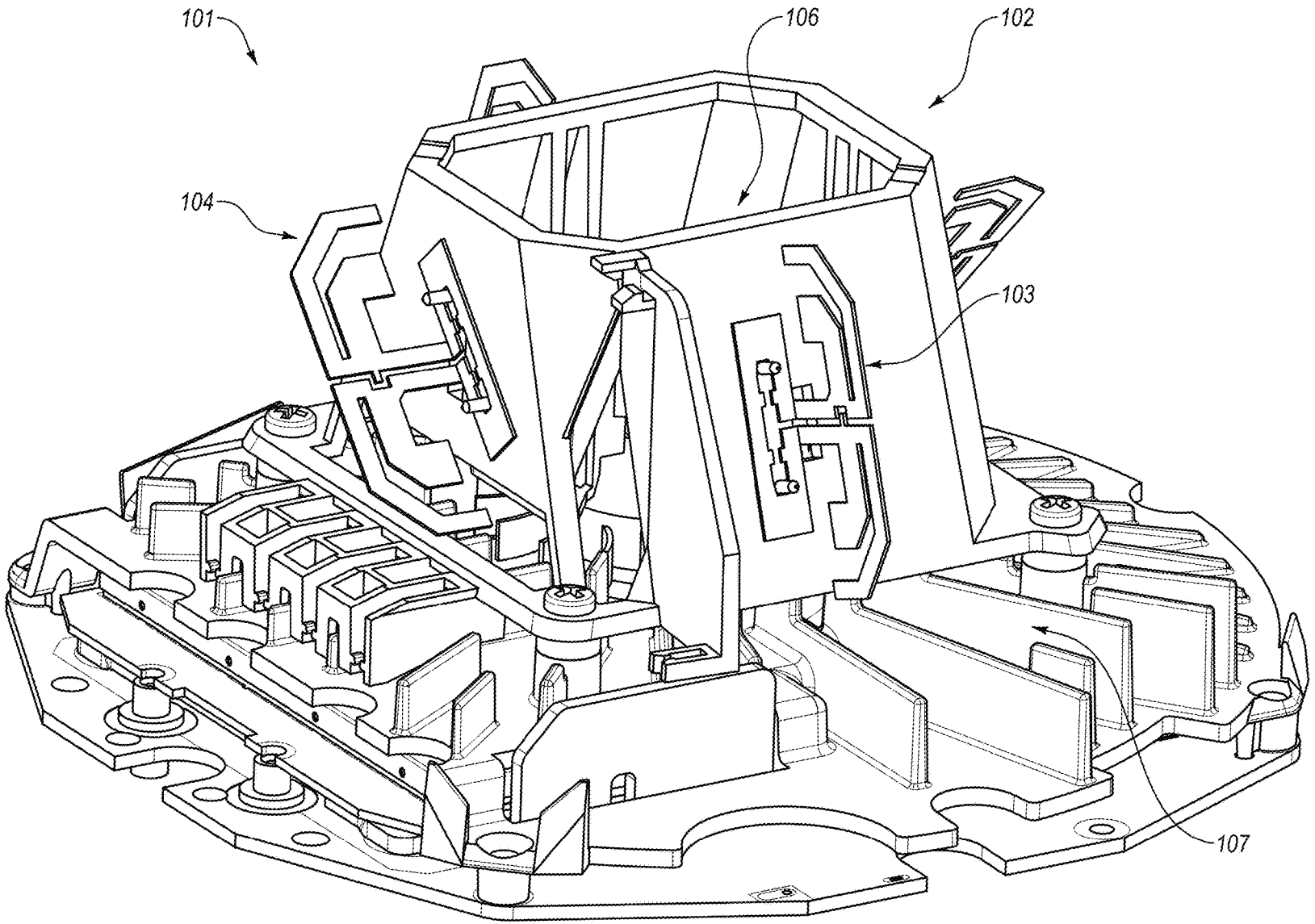

FIGS. 1A and 1B show a wireless device 100 such as a Wi-Fi router according to an embodiment. The wireless device 100 may comprise an antenna system 101, which may include a frame 102 with at least three facets 103 as illustrated in FIGS. 1A and 1C through 1H. The antenna system may further comprise an antenna element 104 mounted on each of the at least three facets 103. FIGS. 1A and 1C through 1H illustrate an exemplary embodiment comprising four facets 103 and four antenna elements 104. In some embodiments, other numbers of antenna elements and facets may be used. For example, in some embodiments, the frame 102 may comprise five facets 103 with an antenna element 104 mounted on each facet, and in some other embodiments, the frame 102 may comprise eight facets 103 with an antenna element 104 mounted to each facet. In some embodiments, the frame 102 may include antenna elements 104 on some, but not all facets 103. In some embodiments, the frame 102 may include multiple antenna elements 104 on one or more of the facets 103.

The antennas elements 104 may be isolated from each other. In some embodiments, each of the antennas elements 104 is electromagnetically isolated from each of the other antenna elements 104. In some embodiments, some of the antennas elements 104 are isolated from each other and other antennas elements 104 are not isolated from each other. In some embodiments, the antennas elements 104 may be isolated from each other with greater than 10 dB of RF orthogonality. In some embodiments, the antennas elements 104 may be isolated from each other with greater than 20 dB of RF orthogonality. In some embodiments, the antenna elements 104 are isolated from each other with between 25 and 30 dB of RF orthogonality. In some embodiments, other ranges of isolation are possible, such as isolation of less than 10 dB or greater than 30 dB of RF orthogonality.

The antenna elements 104 may be mounted to the frame 102 in a fixed manner. The use of fixed antennas elements fitted inside the enclosure may provide better performance than user-adjustable movable antennas that are typically mounted externally to the enclosure. For example, in some embodiments, the antenna elements 104 may be fixed in an orientation that provides desired performance characteristics. By contrast, with movable antennas, a user may not be able to readily determine an optimal arrangement for the antennas.

The frame 102 may be fitted with passive metallic elements (not shown) that act as reflectors to shape the radiation pattern. The frame 102 may also be fitted with isolators (not shown) to augment the level of isolation between antenna elements 104.

The wireless device 100 may comprise an enclosure 105. In some embodiments, the compact arrangement of the antenna elements 104 mounted to the antenna system 101 allows the antenna elements 104 to be located entirely within the enclosure 105. In other embodiments, some or all of the antenna elements 104 may be located partially or entirely outside the enclosure 105. In some embodiments, the antenna system 101 may be located entirely within the enclosure 105. In other embodiments, some or all of the antenna system 101 may be located partially or entirely outside the enclosure 105. By locating the antenna system 101, including the antenna elements 104 within the enclosure 105, the wireless device 100 may have a smaller size and more desirable appearance. In some embodiments, the small size may improve the functionality of the antenna system 101 by occupying less space while delivering the same or better wireless performance than other wireless devices would deliver for a given size.

Figure 1G:
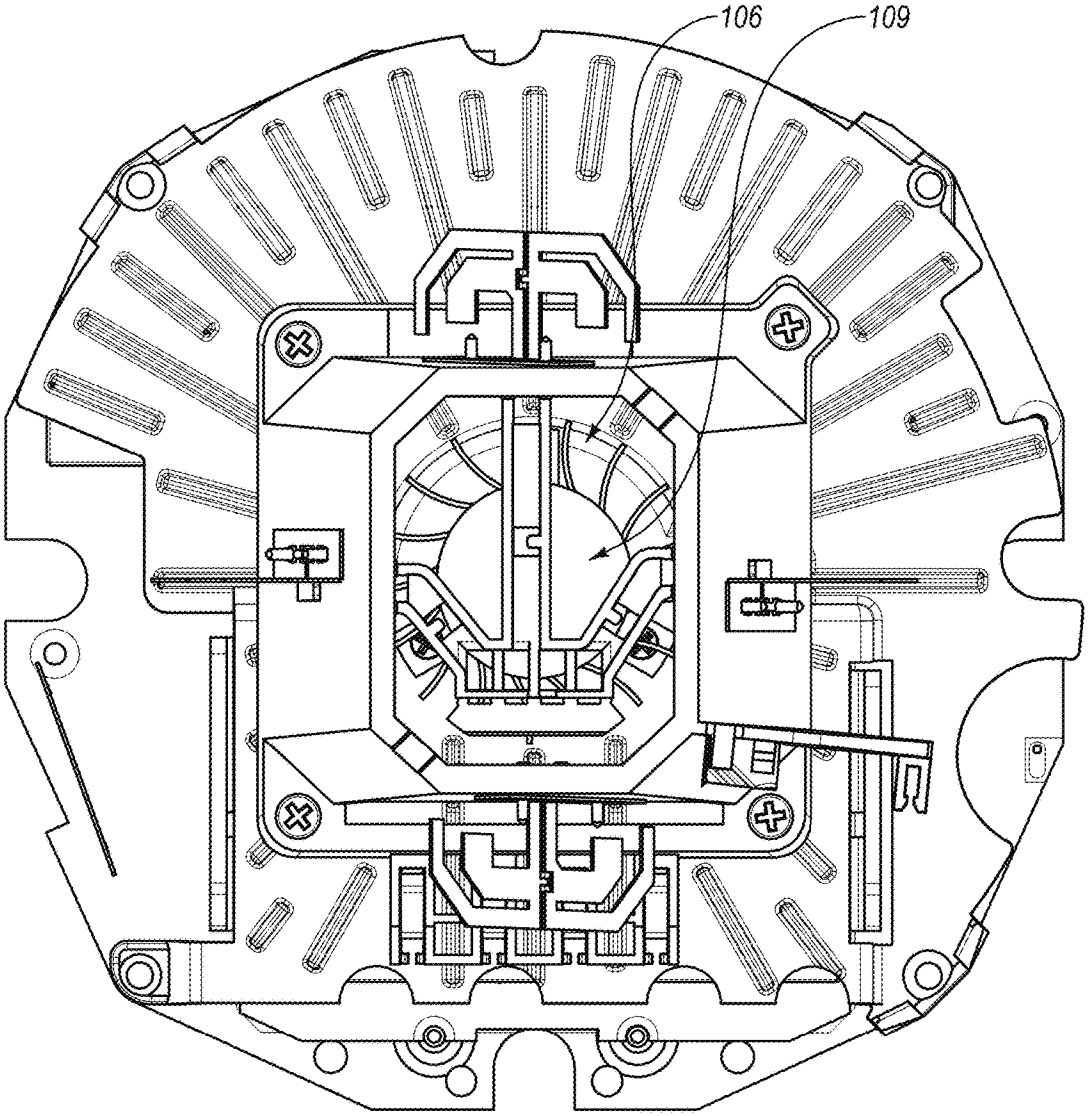
Figure 1H:
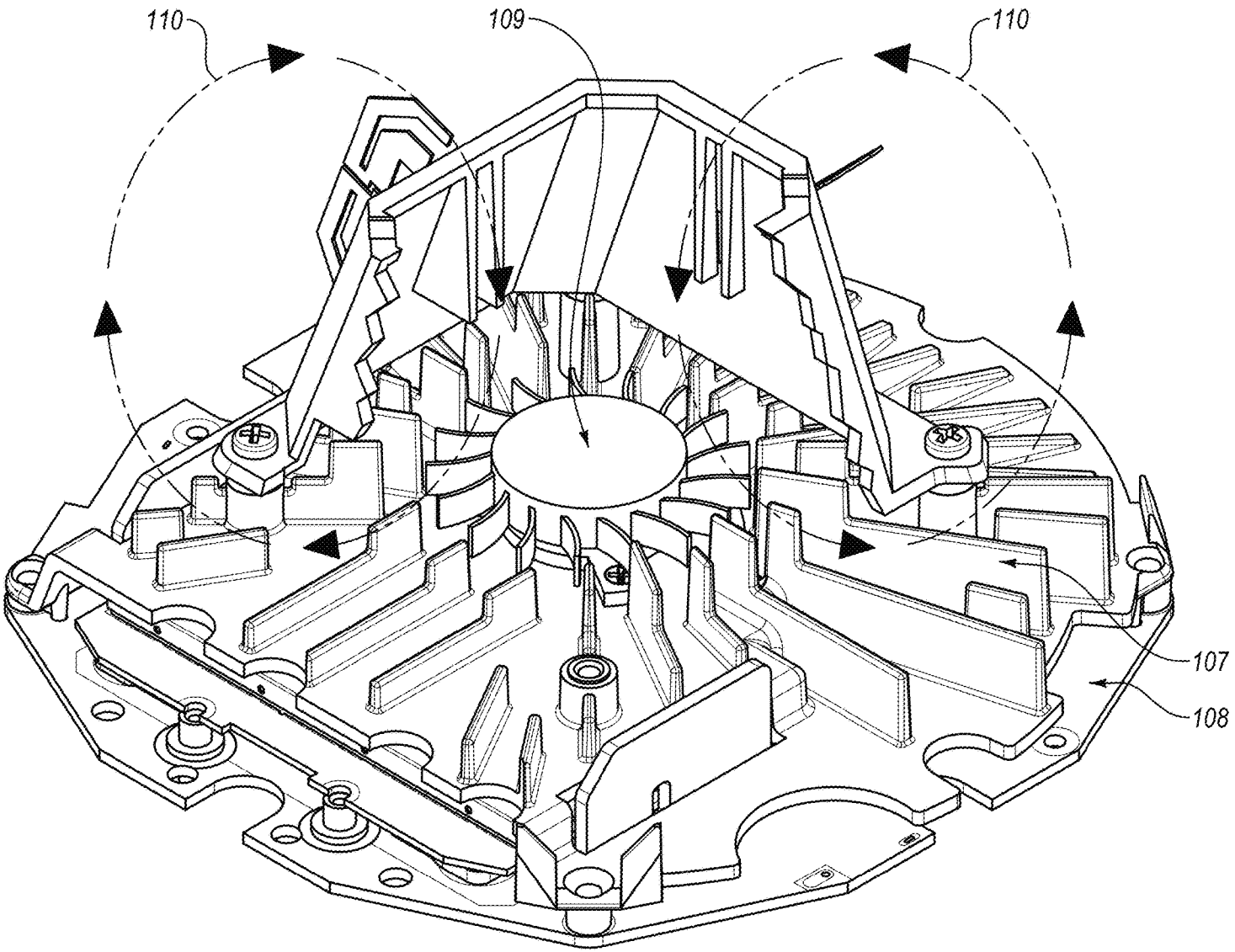

The antenna system 101 may comprise an opening 106 between a top of the frame 102 and a bottom of the frame 102. The frame 102 may allow for circulation of air through the frame 102. For example, the frame 102 may include one or more openings 106 through which air may circulate. In some embodiments, other coolants may circulate, such as cooling liquids and/or cooling gases. In some embodiments, a blower 109 may be located in the opening 106 to increase the circulation of air 110 and/or other fluids to improve cooling as shown in FIGS. 1G and 1H. In some embodiments, the opening 106 may pass only partially through the frame 102.

The wireless device 100 may further comprise a heat sink 107 and a circuit board 108 as shown in FIGS. 1A, 1F, 1G, and 1H. The heat sink 107 may be located between the antenna system 101 and the circuit board 108. By separating the circuit board 108 from the antenna system 101, electromagnetic interference can be reduced between circuitry connected to the circuit board 108 and the antenna system 101. In some embodiments, some or all of the circuitry is separated from the antenna system 101 and does not suffer from the electromagnetic radiations from the antenna system 101. By reducing or eliminating the circuitry located near the antenna system 101, performance may be improved by reducing interference to and/or from the circuitry. In some embodiments, the circuit board 108 and the circuitry may be separated from the antenna system 101 by other electromagnetic insulators such as metal covers, metal plates, electromagnetic gaskets, or electromagnetic-wave absorbing materials, which may be used in addition to the heat sink 107 or instead of the heat sink 107.

In some embodiments, an angle of the antenna elements 104 may be configured to improve RF orthogonality and/or other electromagnetic characteristics of the antenna elements 104. For example, as illustrated in FIGS. 1A through 1D and FIGS. 1F through 1H, the antenna system 100 may comprise first and second antenna elements 104 that are mounted on first and second opposing facets 103 and oriented vertically and third and fourth antenna elements 104 that are mounted on third and fourth opposing facets 103 and mounted diagonally in opposite direction from each other. In some embodiments, other angles and configurations may be used.

In some embodiments, an angle of the facets 103 may be configured to improve the RF orthogonality and/or other electromagnetic characteristics of the antenna elements 104. For example, the first and second opposing facets 103 may be angled inward between 5 and 25 degrees (inclusive) and the third and fourth opposing facets may be angled inward between 0 and 5 degrees (inclusive). In some embodiments, the first and second opposing facets 103 may be vertical and the third and fourth opposing facets 103 may be angled inward by 10 degrees. In some embodiments, other angles and configurations may be used.

In some embodiments, the antenna system 101 may allow the antenna elements 104 to be more closely spaced. For example, in some embodiments, the antenna elements 104 may be spaced less than one wavelength from each other. In some embodiments the antenna elements 104 may be spaced less than one half wavelength from each other. In some embodiments the antenna elements 104 may be spaced less than one quarter wavelength from each other. In other embodiments, the spacing may be varied. In some embodiments, the spacing between the antenna elements 104 may be the same between each opposing antenna and in other embodiments, the spacing may differ between antennas.

In some embodiments, one or more of the antenna elements 104 may be omnidirectional antennas. In some embodiments, one or more of the antenna elements 104 may be directional antennas. In some embodiments, by arranging the antenna elements 104 around the antenna system 101 and/or by separating the antenna elements 104 from the circuit board 108 and related circuitry, electromagnetic interference associated with the omnidirectional antennas may be reduced and performance may be improved.

Figure 2A:
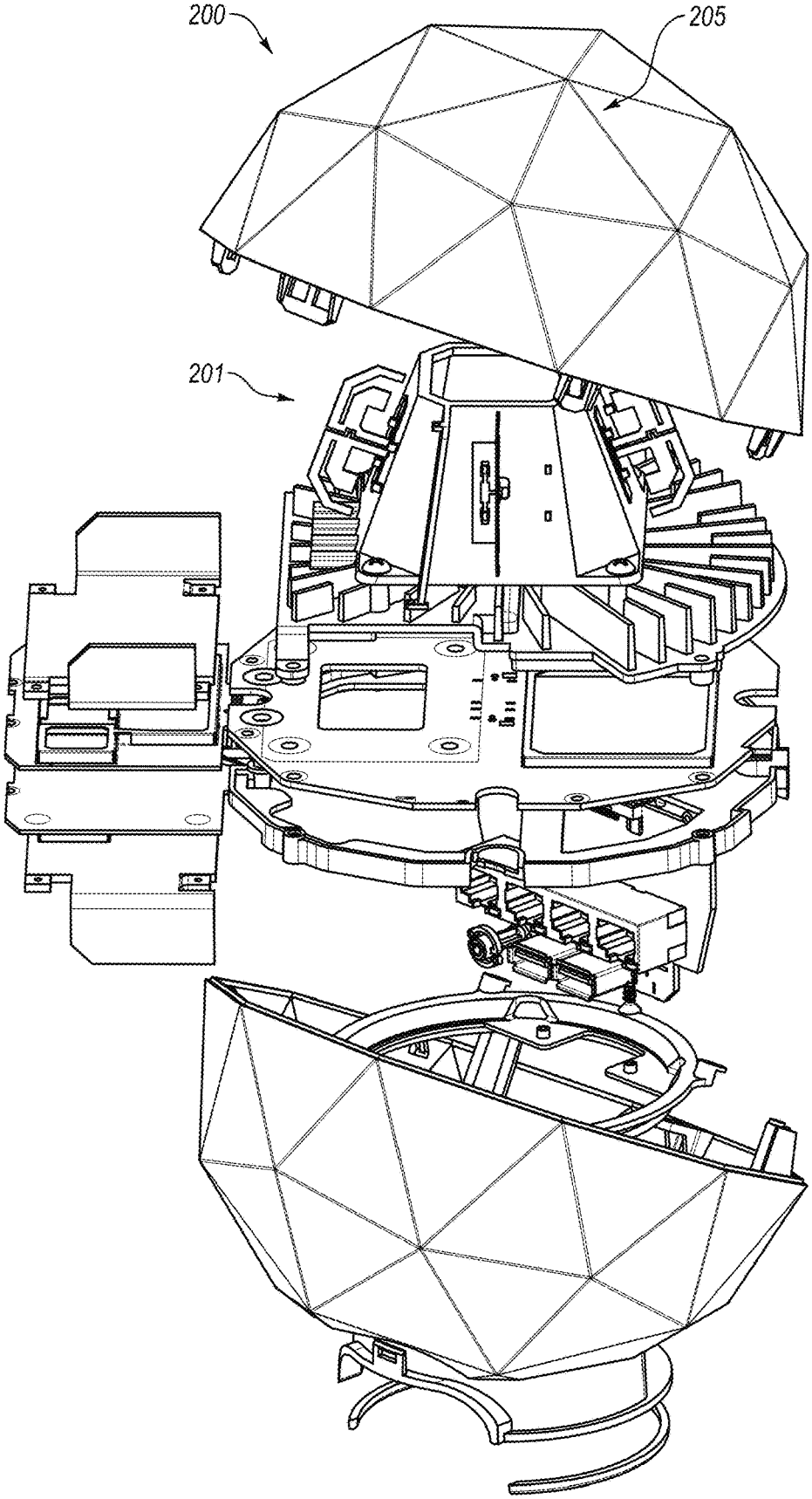
FIGS. 2A and 2B shows an antenna system according to an exemplary embodiment.
Figure 2B:
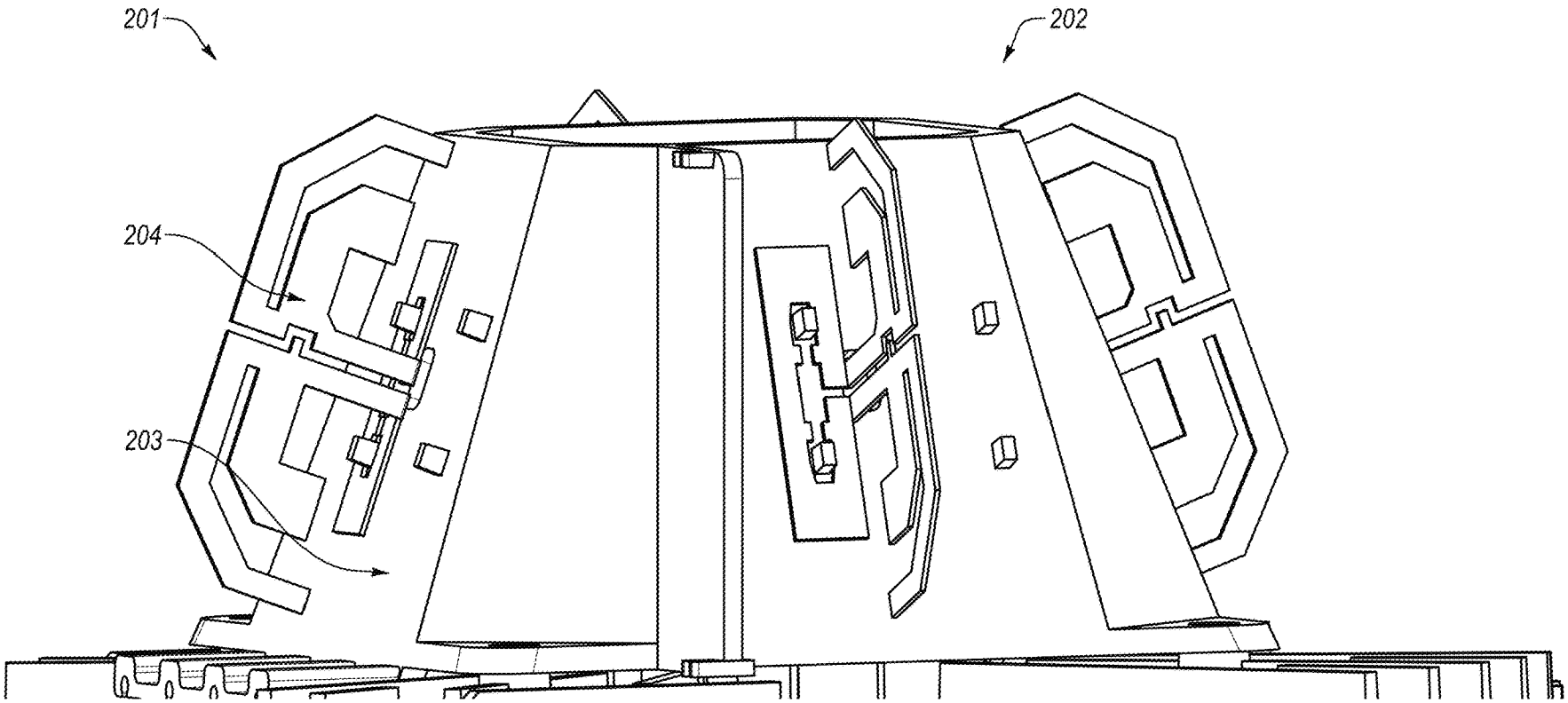

FIGS. 2A and 2B show an antenna system 201 for a Wi-Fi router 200 with an enclosure 205 according to an embodiment. The antenna system 201 may comprise a frame 202 with at least three facets 203. The antenna system 201 may further comprise an antenna element 204 mounted on each of the at least three facets 203. FIG. 2B illustrates an exemplary embodiment of an antenna system 201 comprising of a frame 202 and four facets 203 and four antenna elements 204. In this embodiment, each of the facets 203 may be angled inward at a similar angle, and each of the antenna elements 204 may be oriented vertically. The Wi-Fi router 200 may also include elements such an opening, a heat sink, circuitry, and a blower, as described in connection with FIG. 1 and other figures.

Figure 3:
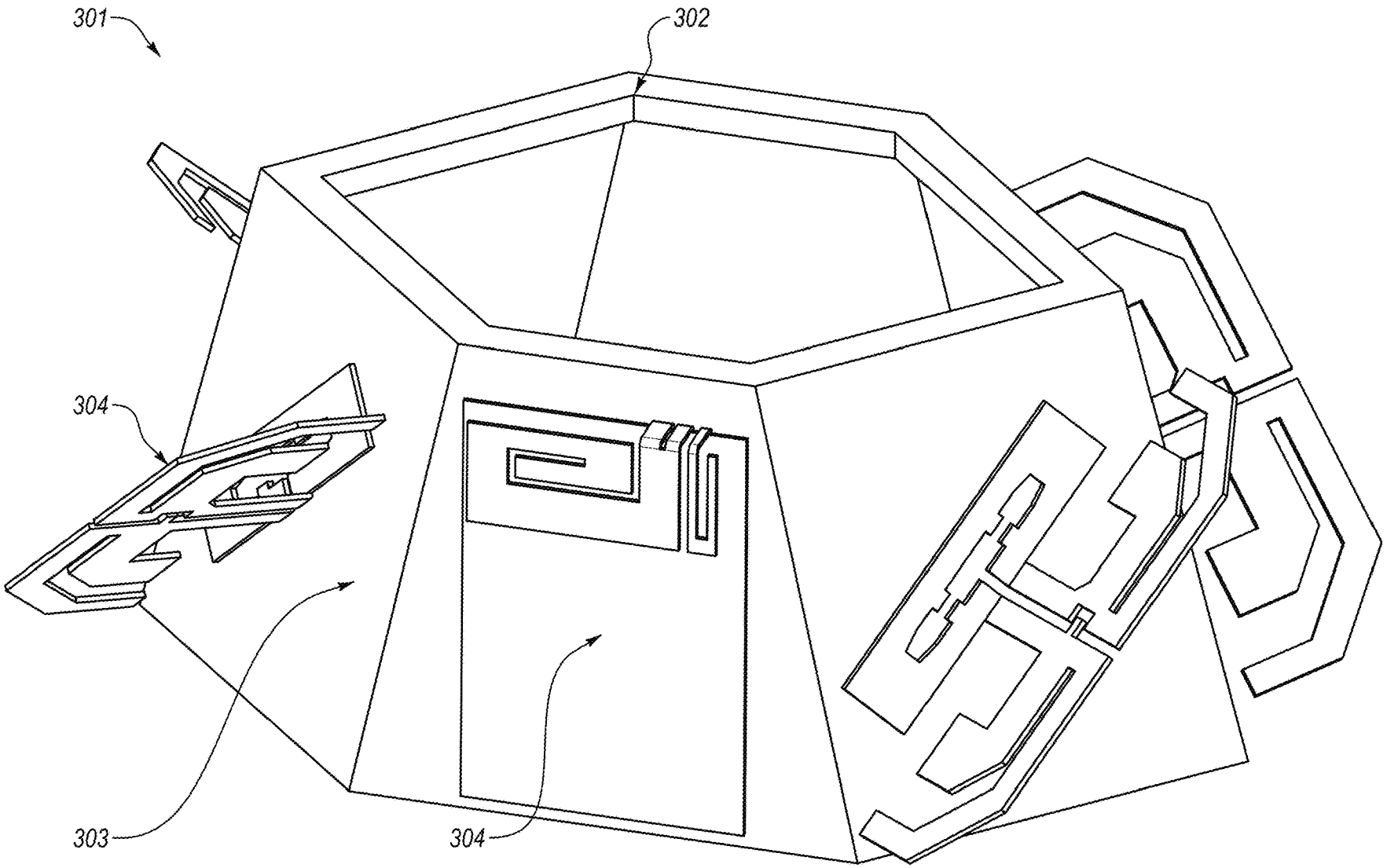
FIG. 3 shows an antenna system according to an exemplary embodiment.

FIG. 3 shows an antenna system 301 according to an embodiment. The antenna system 301 may comprise frame 302 with at least three facets 303. The antenna system 301 may further comprise an antenna element 304 mounted on each of the at least three facets 303. FIG. 3 illustrates an exemplary embodiment comprising six facets 303 and six antenna elements 304. FIG. 3 further illustrates an example of an antenna system 301 using different types of antenna elements, e.g., four antenna elements of a first type, such as a "dipole" type and two antenna elements of a second type, such as a "patch" type. Antenna system 301 may be used with wireless devices such as those illustrated in FIGS. 1 and 2.

Figure 4:
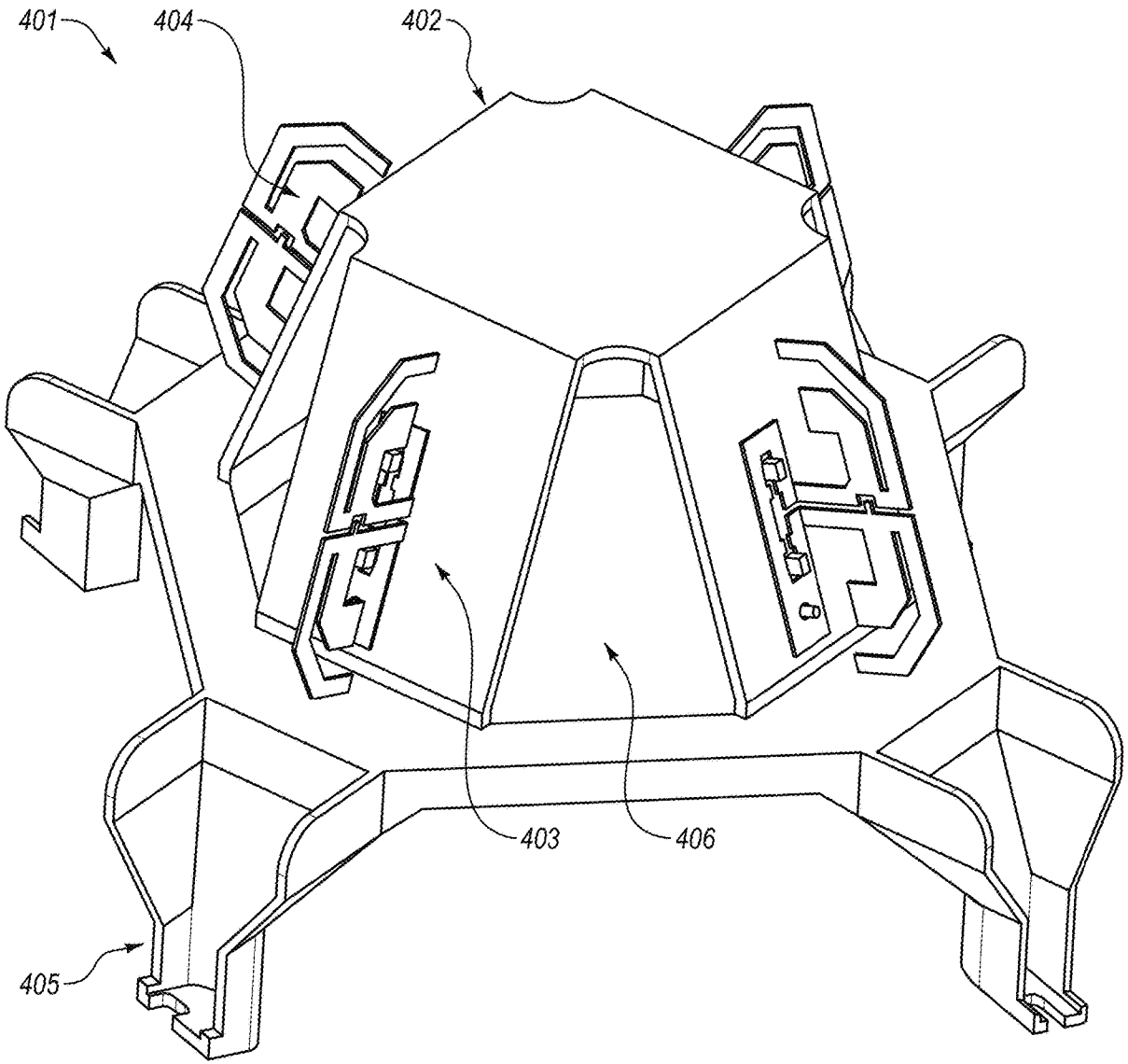
FIG. 4 shows an antenna system according to an exemplary embodiment.
Figure 5:
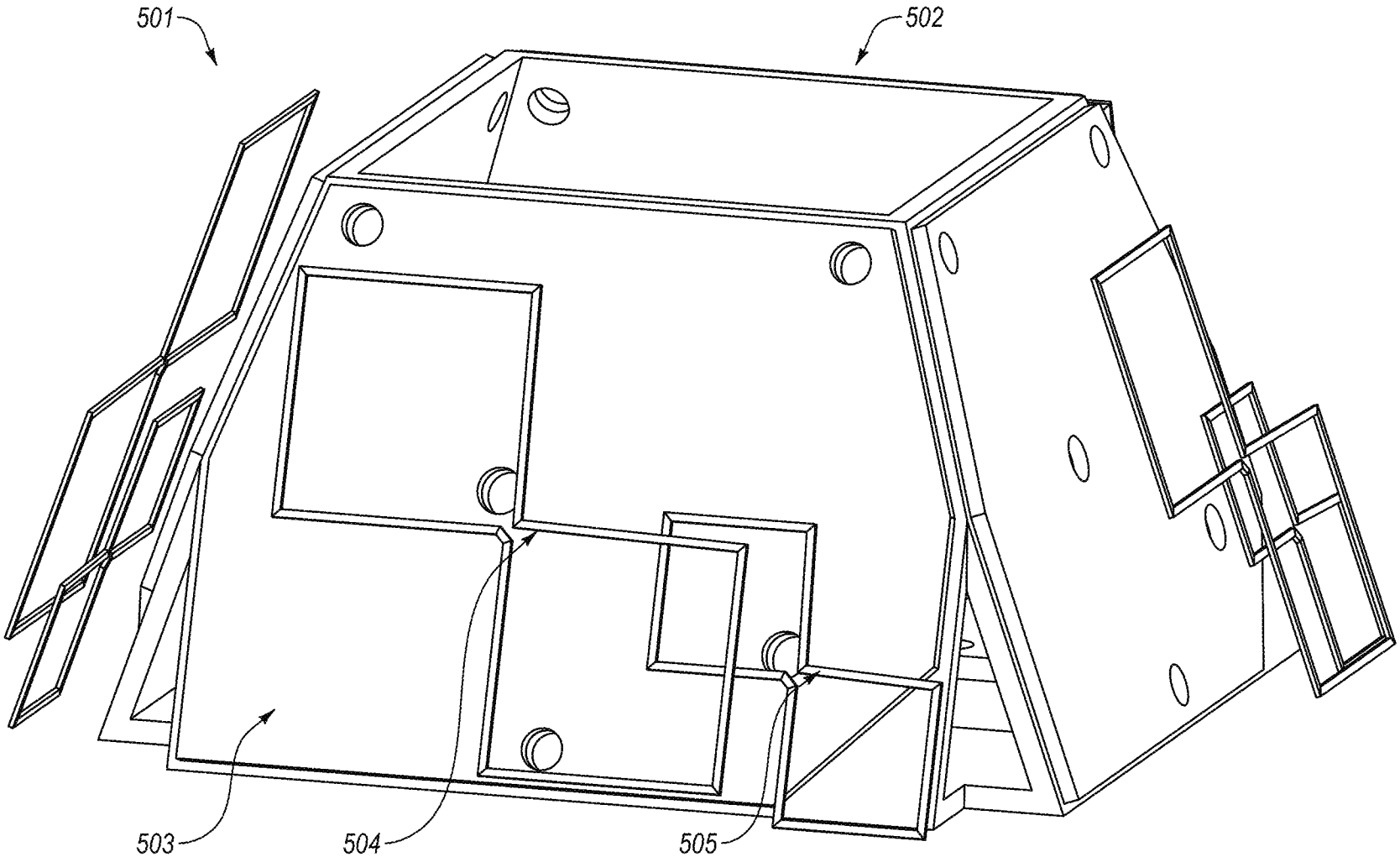
FIG. 5 shows an antenna system according to an exemplary embodiment.

FIG. 4 illustrates an exemplary embodiment of an antenna system 401 comprising a frame 402, four facets 403 and four antenna elements 404. FIG. 4 further illustrates an example of an antenna system 401 where each facet 403 may be separated by voids 406. The voids 406 may be used for cooling, e.g., by circulating air or other fluids through the frame 402. The voids 406 may also be used to insert passive antenna elements. The passive antenna elements may, for example, be used for creating constructive RF interference. The tower frame 402 may additionally comprise one or more legs 405. FIG. 5 shows an exemplary embodiment with four legs 405. The legs 405 may elevate the antenna system 401 to allow air to circulate and/or to increase the spacing between the antenna elements 404 and other elements such as circuitry. Antenna system 401 may be used with wireless devices such as those illustrated in FIGS. 1 and 2.

FIG. 5 shows an antenna system 501 according to an exemplary embodiment. The antenna system 501 may comprise a frame 502 with at least three facets 503. The antenna system 501 may further comprise an antenna element 504 and an antenna element 505 mounted on each of the at least three facets 503. FIG. 5 illustrates an exemplary embodiment comprising four facets 503, four antenna elements 504 of the 2 GHz "Bi-Quad" type and four antenna elements 505 of the 5 GHz "Bi-Quad" type. FIG. 5 further illustrates an example of an antenna system 501 where the facets 503 are constructed of materials comprising an RF reflector such as copper or other metal. Antenna system 501 may be used with wireless devices such as those illustrated in FIGS. 1 and 2.

Figure 6:
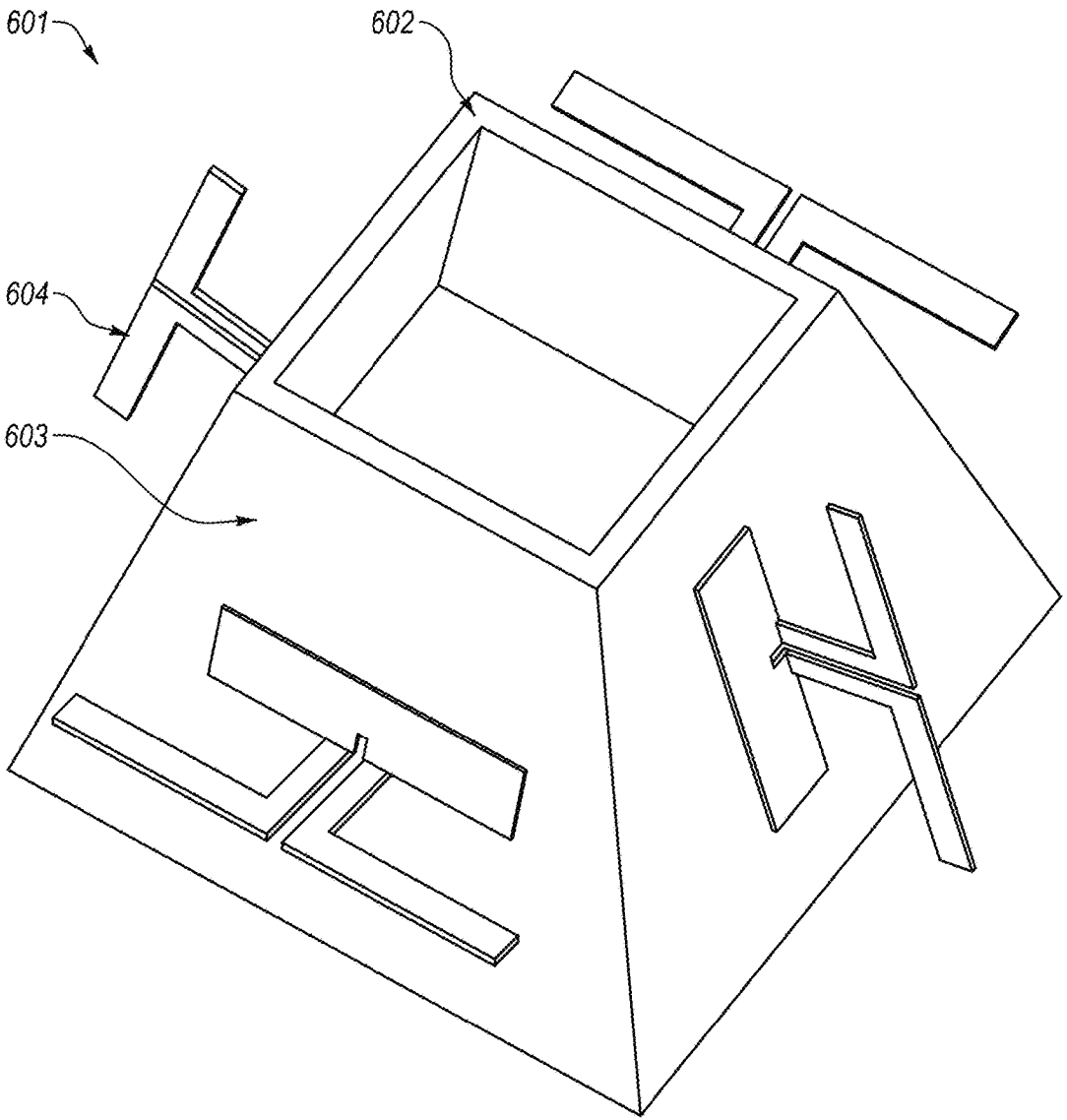
FIG. 6 shows an antenna system according to an exemplary embodiment.

FIG. 6 shows an antenna system 601 according to an exemplary embodiment. The antenna system 601 may comprise a frame 602 with at least three facets 603. The antenna system 601 may further comprise an antenna element 604 mounted on each of the at least three facets 603. FIG. 6 illustrates an exemplary embodiment comprising four facets 603 and four antenna elements 604. FIG. 6 further illustrates an example of an antenna system 601 where two of the antenna elements 604 on opposing facets 603 are oriented substantially vertically and two of the antenna elements 604 on opposing facets 603 are oriented substantially horizontally. Antenna system 601 may be used with wireless devices such as those illustrated in FIGS. 1 and 2.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Further, although the present disclosure has been described herein in the context of at least one particular implementation in at least one particular environment for at least one particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

The invention claimed is:

1. An antenna system comprising:

a frame having a top portion and at least three side facets, wherein the at least three side facets are secured to the top portion of the frame, and wherein each of the at least three facets is separated from adjacent facets creating a void between adjacent facets;

an antenna element mounted on each of the at least three facets, wherein each of the antenna elements is separated from adjacent antenna elements such that the antenna elements lack any direct contact with each other and wherein each of the antenna elements is electromagnetically isolated from each other;

a blower configured to circulate air through the voids between adjacent facets;

a circuit board; and a heatsink located between the frame and the circuit board.

2. The antenna system of claim 1, further comprising:

an enclosure, wherein the frame, the antenna elements, the blower, the circuit board, and the heatsink are located entirely within the enclosure.

3. The antenna system of claim 2 wherein the heatsink includes a plurality of flanges and wherein the heatsink, including the plurality of flanges, is located entirely within the enclosure.

4. The antenna system of claim 1, wherein the antenna elements are placed less than one wavelength away from each other.

5. The antenna system of claim 1 wherein the antenna elements have greater than 10 dB of orthogonality.

6. The antenna system of claim 1, wherein the antenna elements have greater than 20 dB of orthogonality.

7. The antenna system of claim 1, wherein the antenna elements have between 25 and 30 dB of orthogonality.

8. The antenna system of claim 1, wherein the frame comprises four side facets.

9. The antenna system of claim 1, wherein the frame comprises eight side facets.

10. The antenna system of claim 1, wherein the antenna elements are placed less than one half wavelength away from each other.

11. The antenna system of claim 1, wherein the antenna elements are placed less than one quarter wavelength away from each other.

12. The antenna system of claim 1, wherein the antenna elements are omnidirectional antennas.

* * * * *